US008041286B2

(12) United States Patent
Won

(10) Patent No.: US 8,041,286 B2
(45) Date of Patent: Oct. 18, 2011

(54) IMAGE FORMING APPARATUS

(75) Inventor: Jung Yun Won, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 857 days.

(21) Appl. No.: 11/869,152

(22) Filed: Oct. 9, 2007

(65) Prior Publication Data

US 2008/0136080 A1 Jun. 12, 2008

(30) Foreign Application Priority Data

Dec. 7, 2006 (KR) ..... 10-2006-0123939

(51) Int. Cl.
*G03G 15/00* (2006.01)

(52) U.S. Cl. ..... 399/393; 399/397

(58) Field of Classification Search ..... 399/393
See application file for complete search history.

(56) References Cited

U.S. PATENT DOCUMENTS

| | | | | |
|---|---|---|---|---|
| 2,925,311 | A * | 2/1960 | Dull | 346/82 |
| 4,888,617 | A * | 12/1989 | Okuzawa | 355/400 |
| 5,078,380 | A * | 1/1992 | Kitazawa | 271/9.05 |
| 5,228,676 | A * | 7/1993 | Arai et al. | 271/117 |
| 5,390,016 | A * | 2/1995 | Hoshi et al. | 399/371 |
| 5,459,553 | A * | 10/1995 | Kim | 399/20 |
| 5,594,486 | A * | 1/1997 | Kiyohara | 347/104 |
| 5,897,112 | A * | 4/1999 | Kwag | 271/38 |
| 6,994,341 | B2 * | 2/2006 | Aoki et al. | 271/117 |
| 7,063,315 | B2 * | 6/2006 | Lyu et al. | 271/38 |
| 7,457,580 | B2 * | 11/2008 | Kitamura | 399/393 |
| 7,467,791 | B2 * | 12/2008 | Matsushima | 271/126 |
| 7,571,909 | B2 * | 8/2009 | Saeki et al. | 271/292 |

FOREIGN PATENT DOCUMENTS

KR 2005-19416 3/2005

* cited by examiner

*Primary Examiner* — Anthony H. Nguyen
(74) *Attorney, Agent, or Firm* — Stanzione & Kim, LLP

(57) ABSTRACT

An image forming apparatus includes a structure to lift or lower a paper loading tray without a separate drive source while preventing damage to constituent elements even under an abnormal situation in that excessive force is transmitted to the paper loading tray. The image forming apparatus includes a paper feeding cassette including a paper loading tray and a lifting member to lift or lower the paper loading tray, the paper feeding cassette being detachably coupled to the body, a power intermittence device to intermit power to be transmitted from a drive source provided in a body of the image forming apparatus to the lifting member, and a power transmission device to transmit the power transmitted through the power intermittence device to the lifting member by use of at least one worm gear. The image forming apparatus further includes a safety lever having one end to cooperate with a pickup roller assembly. The other end of the safety lever is pivotally rotatable between a first position where the other end of the safety lever restrains the power intermittence device so as not to transmit power to the lifting member and a second position where the other end of the safety lever is spaced apart from the power intermittence device so as to transmit the power to the lifting member.

22 Claims, 6 Drawing Sheets

IMAGE FORMING APPARATUS

CROSS-REFERENCE TO RELATED APPLICATIONS

This application claims the benefit of Korean Patent Application No. 2006-0123939, filed on Dec. 7, 2006 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus in which a paper loading tray has an improved lifting and/or lowering structure to load one or more sheets of paper as a printing medium.

2. Description of the Related Art

An image forming apparatus is configured to print an image on a sheet of paper as a printing medium on the basis of an image signal inputted into the image forming apparatus. The image forming apparatus generally includes a body defining the outer appearance of the image forming apparatus, a paper feeding unit to automatically feed sheets of paper, a printing unit to apply toner or ink, selected depending on a printing manner, onto each fed sheet of paper and form an image on the fed sheet of paper, and a paper discharge unit to discharge the printed sheet of paper out of the body.

The paper feeding unit includes a paper loading tray to load, therein, the sheets of paper to be fed and a lifting device to lift the paper loading tray toward a pickup roller upon receiving power from a motor. The sheets of paper loaded in the paper loading tray are picked up one by one by the pickup roller and transported to the printing unit.

An example of the image forming apparatus having the above described paper feeding unit is disclosed in Korean Patent Laid-open Publication No. 2005-0019416. The disclosed image forming apparatus includes a motor as a drive source, a cam installed below a paper loading tray to lift or lower the paper loading tray upon receiving power from the motor, and a power transmission mechanism (for example, a series of reduction gears) to reduce the power from the motor and transmit the reduced power to the cam. If the motor rotates in response to a printing command, the power of the motor is transmitted to the cam through the series of reduction gears so that the cam is rotated, thereby causing the paper loading tray, which supports sheets of paper therein, to be lifted. If the sheets of paper reach a predetermined height and a sensor detects the height of the sheets of paper, the operation of the motor is stopped by a detecting signal from the sensor. Then, the sheets of paper are picked up one by one by a pickup roller and fed to a printing unit. If the sheets of paper have a reduced height by continuing the paper feeding operation and the sensor detects the reduced height, the operation of the motor is resumed by a detecting signal from the sensor, such that the paper loading tray is lifted as high as the sheets of paper are discharged.

However, the above described conventional image forming apparatus has a problem of high manufacturing costs and great consumption of electric power because of the separate motor required to lift or lower the paper loading tray. Further, the conventional image forming apparatus has no means for dealing with malfunction of the sensor that is used to detect the height of sheets of paper, or failure in the control of the motor due to unexpected reasons. Therefore, if excessive power is transmitted from the motor under an abnormal situation, there is a high risk of damage to constituent elements of the image forming apparatus.

SUMMARY OF THE INVENTION

The present general inventive concept provides an image forming apparatus capable of lifting or lowering a paper loading tray without using a separate drive source.

The present general inventive concept provides an image forming apparatus capable of preventing damage to constituent elements of the image forming apparatus even under an abnormal situation in that excessive power is transmitted to a paper loading tray.

Additional aspects and/or advantages of the invention will be set forth in part in the description which follows and, in part, will be obvious from the description, or may be learned by practice of the invention.

The foregoing and/or other aspects and utilities of the present general inventive concept may be achieved by providing an image forming apparatus including a body including an image forming mechanism and a drive source, a paper feeding cassette including a paper loading tray and a pivotally rotatable lifting member to lift or lower the paper loading tray, the paper feeding cassette being detachably coupled to the body, a power intermittence device to intermit power to be transmitted from the drive source to the lifting member, and a power transmission device to transmit the power transmitted through the power intermittence device to the lifting member, wherein the power transmission device may include at least one worm gear.

The power intermittence device may include a first hub rotatably connected to the drive source; a clutch spring having a portion coupled to the first hub, a second hub coupled to a first end of the clutch spring, a clutch hub disposed between the first hub and the second hub to surround the clutch spring, a second end of the clutch spring being secured to the clutch hub, and a restraint unit to restrain movement of the clutch hub.

The power transmission device may further include a first rotating shaft coupled to the second hub so as to rotate along with the second hub; and a second rotating shaft extending perpendicular to the first rotating shaft, and the at least one worm gear may include a first worm gear including a first worm formed at the first rotating shaft and a first worm wheel formed at a first end of the second rotating shaft to be engaged with the first worm, and a second worm gear including a second worm formed at a second end of the second rotating shaft and a second worm wheel to be engaged with the second worm.

The clutch hub may include at least two holding protrusions formed at an outer peripheral surface of the clutch hub, and the restraint unit may include a locking member movable between a locking position where the locking member interferes with any one of the holding protrusions and an unlocking position where the locking member is spaced apart from the holding protrusions; and an actuator to move the locking member.

The image forming apparatus may further include a pickup roller assembly installed above the paper loading tray in an upwardly and downwardly movable manner, and a safety lever having a first end to cooperate with the pickup roller assembly and a second end that is movable between a locking position where the second end of the safety lever interferes with any one of the holding protrusions and an unlocking position where the second end of the safety lever is spaced apart from the holding protrusions.

The foregoing and/or other aspects and utilities of the present general inventive concept may also be achieved by providing an image forming apparatus including a body including an image forming mechanism and a drive source, a paper feeding cassette including a paper loading tray and a pivotally rotatable lifting member to lift or lower the paper loading tray, the paper feeding cassette being detachably coupled to the body, a pickup roller assembly installed to the body so as to move up and down above the paper loading tray, a power intermittence device to intermit power to be transmitted from the drive source to the lifting member, and a safety lever having a first end to cooperate with the pickup roller assembly, wherein the safety lever further has a second end that is pivotally rotatable between a first position where the second end of the safety lever restrains the power intermittence device so as not to transmit the power to the lifting member and a second position where the second end of the safety lever is spaced apart from the power intermittence device so as to transmit the power to the lifting member.

The image forming apparatus may further include a power transmission device to transmit the power transmitted through the power intermittence device to the lifting member, and the power transmission device may comprise at least one worm gear.

The power intermittence device may further include a first hub rotatably connected to the drive source; a second hub to be intermittently connected to the first hub by a clutch spring, and a clutch hub disposed between the first hub and the second hub to surround the clutch spring, a first end of the clutch spring being secured to the clutch hub.

The clutch hub may include at least two holding protrusions formed at an outer peripheral surface of the clutch hub, and the second end of the safety lever may be movable between a locking position where the second end of the safety lever interferes with any one of the holding protrusions and an unlocking position where the second end of the safety lever is spaced apart from the holding protrusions.

The power intermittence device may further include a restraint unit to interfere with any one of the holding protrusions so as to restrain movement of the clutch hub.

The foregoing and/or other aspects and utilities of the present general inventive concept may also be achieved by providing image forming apparatus including a body including an image forming unit and a drive source and to receive a paper feeding cassette having a paper loading tray and a pivotally rotatable lifting member to lift or lower the paper loading tray, and a power intermittence device to selectively disconnect power to be transmitted from the drive source to the lifting member.

The power intermittence device may intermittently transfer the power to the lifting member and separate the drive source and the lifting member according to a height of one or more sheets of paper.

The image forming apparatus may further include a sensor to detect a height of one or more sheets of paper contained in the paper feeding cassette, and the power intermittence device may intermittently transfer the power from the drive source according to the detected height of the one or more sheets of paper.

The image forming apparatus may further include a pickup roller assembly to move between a first position and a second position according to a connection between the paper feeding cassette and the body, and a safety lever to move according to a movement of the pickup roller assembly to control the power intermittence device.

The image forming apparatus may further include an actuator to control the power intermittence device.

The image forming apparatus may further include a power transmitting device having at least one worm gear disposed between the power intermittence device and the lifting member.

The image forming apparatus may further include a coupler gear to couple the lifting member to the power intermittence device when the paper feeding cassette is coupled to the body.

The image forming apparatus may further include a paper feeding unit to feed a sheet of paper contained in the paper feeding cassette, and the drive source may output the power to the paper feeding unit to feed the paper to the printing unit from the paper feeding cassette.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
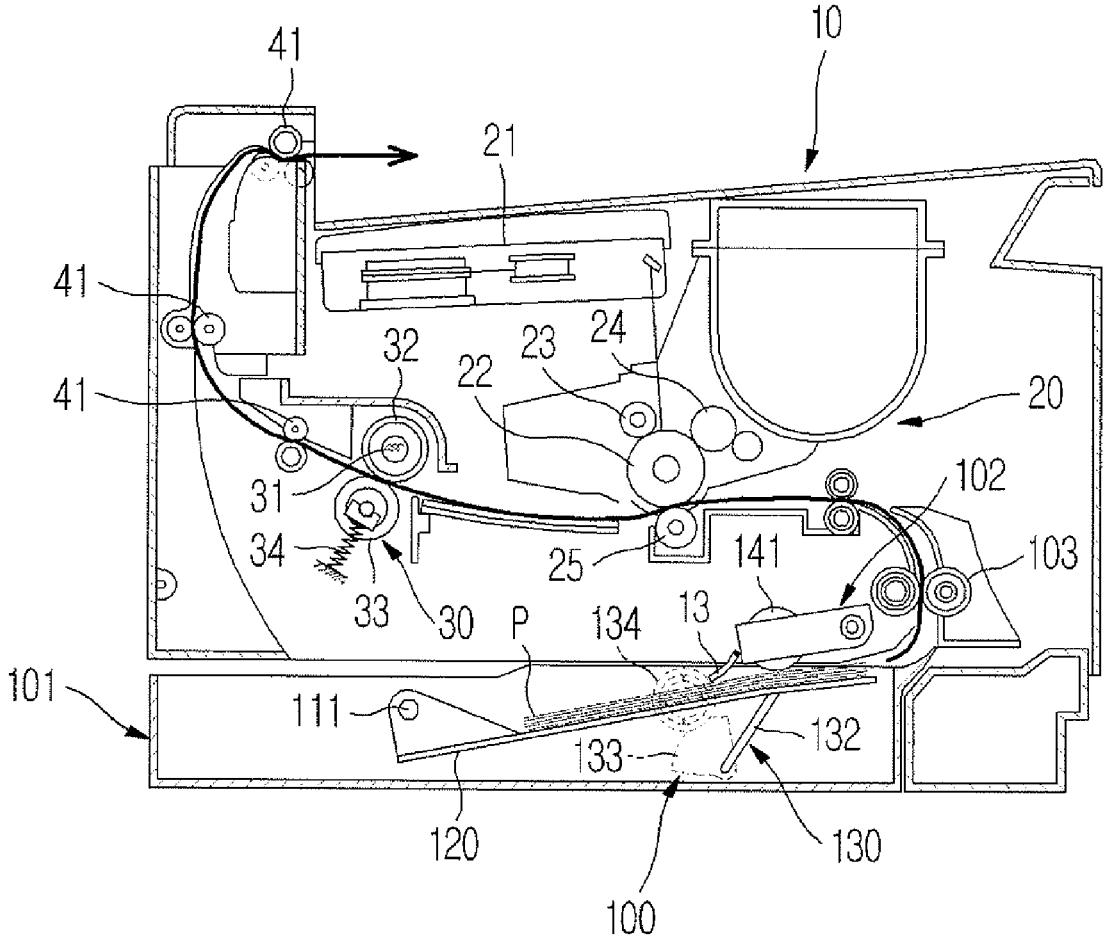
FIG. 1 is a front sectional view showing an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
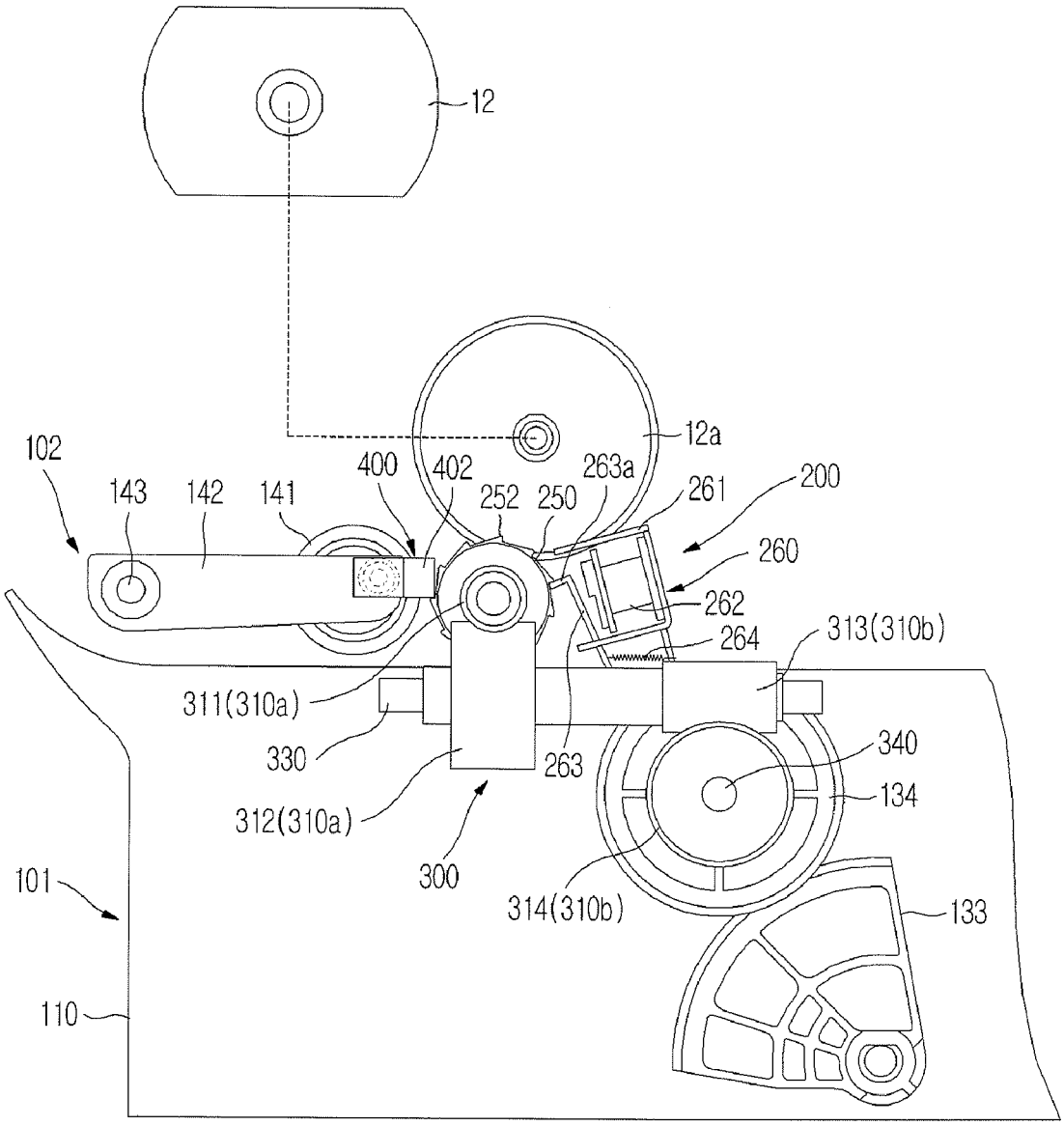
FIG. 2 is a schematic rear view showing the image forming apparatus of FIG. 1 according to an exemplary embodiment of the present general inventive concept.
Figure 3:
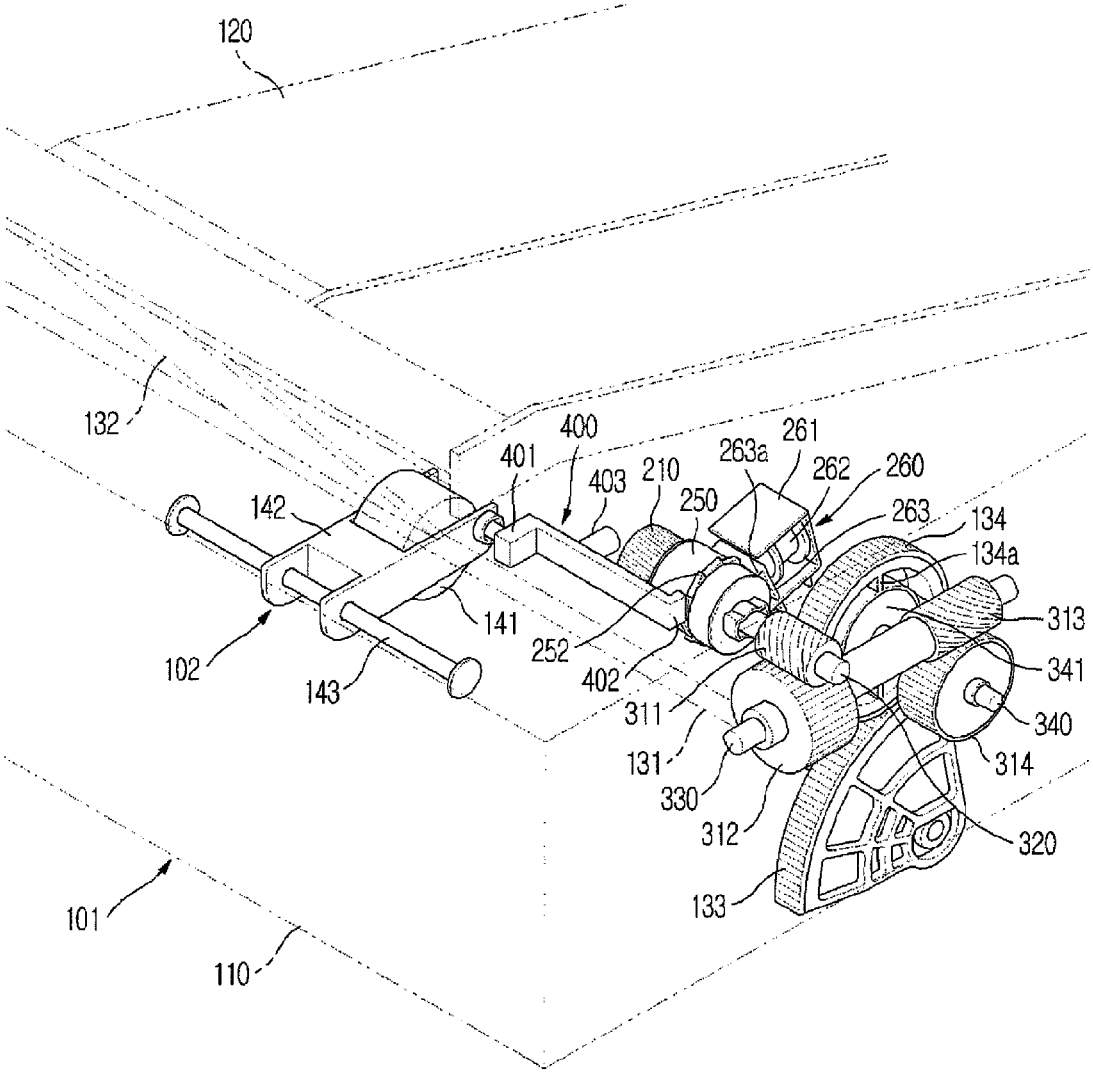
FIG. 3 is a perspective view showing a paper feeding cassette, a pick-up roller assembly, a power intermittence device, and a power transmission device included in the image forming apparatus of FIG. 1 according to an exemplary embodiment of the present general inventive concept.

FIGS. 1 and 2 are a front sectional view and a schematic rear view, respectively, showing an image forming apparatus according to an exemplary embodiment of the present general inventive concept. FIG. 3 is a perspective view showing a paper feeding cassette, a pick-up roller assembly, a power intermittence device, and a power transmission device included in the image forming apparatus of FIGS. 1 and 2 according to an exemplary embodiment of the present general inventive concept. In FIG. 2, the pickup roller assembly and a safety lever are disposed in respective positions in the image forming apparatus when no paper feeding cassette is disposed in the image forming apparatus.

As shown in FIG. 1, the image forming apparatus includes a body 10 to define an outer appearance of the image forming apparatus and adapted to support a variety of elements installed therein, a paper feeding unit 100 to feed sheets of paper P, a developing unit 20 to develop an image on each sheet of paper, a fixing unit 30 to fix the developed image on the sheet of paper with a predetermined pressure and heat, and a paper discharge unit 41 to discharge the printed sheet of paper out of the body 10. The developing unit 20 and the fixing unit 30 constitute an image forming unit to form an image on each sheet of paper and are installed in the body 10.

The paper feeding unit 100 includes a paper feeding cassette 101 to store sheets of paper P as a printing medium, a pickup roller assembly 102 to pick up the sheets of paper P stored in the paper feeding cassette 101 one by one, and transport rollers 103 to move the picked-up sheets of paper toward the developing mechanism 20. The paper feeding cassette 101 is detachably coupled to the body 10. The body 10 has an opening (not shown) formed at a lower end portion of a front surface of the body 10 to receive and be coupled with the paper feeding cassette 101.

The developing unit 20 includes a laser scanning unit 21 to form an electrostatic latent image on a surface of a photosensitive drum 22, an electrical charging roller 23 to electrically charge the photosensitive drum 22, a developing roller 24 to develop the electrostatic latent image formed on the photosensitive drum 22 into a toner image, and a transfer roller 25 to press a sheet of paper toward the photosensitive drum 22 so as to transfer the toner image on the photosensitive drum 22 onto the sheet of paper.

The fixing unit 30 serves to fix the toner image on the sheet of paper with a predetermined pressure and heat. The fixing unit 30 includes a heating roller 32 having a heat source 31 to apply heat to the sheet of paper having the transferred toner image, a pressing roller 33 installed opposite to the heating roller 32 with respect to a paper path between the photosensitive drum 22 and the transfer roller 25 to keep a predetermined fixing pressure between the heating roller 32 and the pressing roller 33, and a pressing member 34 to elastically bias the pressing roller 33, so as to allow the pressing roller 33 to come into close contact with the heating roller 32.

The paper discharge unit 41 includes a series of paper discharge rollers 41 arranged in sequence to transport the sheets of paper having passed through the fixing mechanism 30 to an upper portion of the body 10.

The image forming apparatus further includes a paper detecting sensor 13 to detect a sheet of paper loaded in the paper feeding unit 100.

As shown in FIGS. 1 to 3, the paper feeding cassette 101 includes a cassette body 110, a paper loading tray 120 installed to pivotally rotate up and down and to load one or more sheets of paper P therein, and a lifting/lowering device 130 to lift or lower the paper loading tray 120 upon receiving power from a drive source (12, See FIG. 2) installed in the body 10. The paper loading tray 120 is coupled, at one side thereof, to the cassette body 110 using hinges 111 such that the other side of the paper loading tray 120 is pivotally rotatable by a predetermined angle and moved up and down.

The drive source 12 installed in the body 10 is a drive motor to drive a variety of elements of, for example, a pickup roller 141 and the transport roller 103 of the paper feeding unit 100 and the developing unit 20. According to the present general inventive concept, it is not necessary to have a separate drive source to be exclusively used with the lifting/lowering device 130.

The lifting/lowering device 130 includes a lifting shaft 131, a lifting member 132 coupled to the lifting shaft 131 so as to pivotally rotate together with the lifting shaft 131, a lifting gear 133 installed to a rear surface of the cassette body 110 and adapted to rotate the lifting shaft 131 upon receiving power, and a coupling gear 134 installed in the cassette body 110 to be engaged with the lifting gear 133. The coupling gear 134 is coupled to a coupling portion 341 of a power transmission device 300 that will be described hereinafter when the paper feeding cassette 101 is mounted to the body 10, such that the coupling gear 134 receives power from the drive source 12.

As shown in FIGS. 2 and 3, the pickup roller assembly 102 is installed above the paper loading tray 120 such that the pickup roller assembly 102 can be moved up and down. The pickup roller assembly 102 includes the pickup roller 141, a pickup bracket 142 having one end to rotatably support the pickup roller 141, and a supporting shaft 143 installed to the other end of the pickup bracket 142. When the pickup roller assembly 102 is lifted with respect to the supporting shaft 143, the pickup roller assembly 102 is in a picking waiting position such that the pickup roller 141 is spaced apart from an uppermost one of the sheets of paper loaded in the paper loading tray 120 by a predetermined distance. When the pickup roller assembly 102 is lowered with respect to the supporting shaft 143, the pickup roller assembly 102 is in a picking position such that the pickup roller 141 comes into contact with the uppermost sheet of paper in the paper loading tray 120.

The pickup roller assembly 102 is moved up and down by an up-down member (not shown) that operates in cooperation with the attachment/detachment of the paper feeding cassette 101. Specifically, in a state where the paper feeding cassette 101 has been attached to the body 10, the up-down member operates to move the pickup roller assembly 102 down such that the pickup roller 141 comes into contact with the uppermost sheet of paper. Conversely, when the paper feeding cassette 101 is being coupled to or separated from the body 10, the up-down member operates to move the pickup roller assembly 102 up, so as to prevent the pickup roller assembly 102 from interfering with the paper feeding cassette 101.

The up-down member is well-known in the art and detailed description thereof is omitted. For reference, Korean Patent Registration No. 0574055 discloses an example of the up-down member.

Meanwhile, the paper detecting sensor 13 of FIG. 1) is installed above the paper loading tray 120 and adapted to detect a height of the sheets of paper loaded in the paper loading tray 120 when the paper loading tray 120 is lifted by the lifting device 130.

The image forming apparatus according to an exemplary embodiment of the present general inventive concept further includes a power intermittence device 200 to intermit power to be transmitted from the drive source 12 disposed in the body 10 to the lifting member 132, and the power transmission device 300 to transmit the power having passed through the power intermittence device 200 to the lifting member 132.

Figure 4:
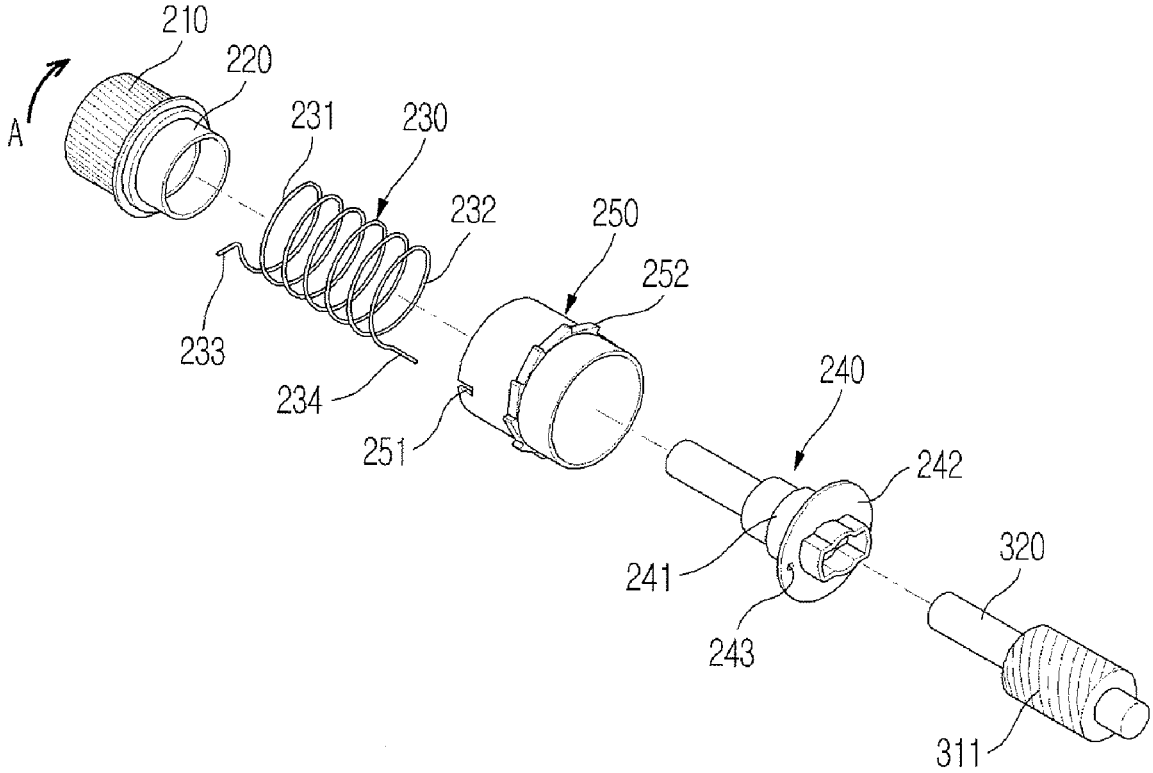
FIG. 4 is an exploded perspective view showing the power intermittence device of the image forming apparatus of FIGS. 1 and 3 according to an exemplary embodiment of the present general inventive concept.

FIG. 4 is an exploded perspective view showing the power intermittence device 200 of the image forming apparatus according to an exemplary embodiment of the present general inventive concept. As shown in FIGS. 2, 3 and 4, the power intermittence device 200 includes a clutch gear 210 rotatably engaged with an idle gear (12*a*, See FIG. 2) that is connected to the drive source 12, a first hub 220 integrally formed with the clutch gear 210, a second hub 240 to be intermittently connected to the first hub 220 by a clutch spring 230, a clutch hub 250 disposed between the first hub 220 and the second hub 240 to surround the clutch spring 230, and a restraint unit 260 to restrain movement of the clutch hub 250.

The clutch spring 230 has a portion 231 inserted around the first hub 220 and an opposite portion 232 inserted around a cylindrical portion 241 of the second hub 240. The clutch spring 230 also has one end 233 secured in a spring securing recess 251 formed in the clutch hub 250 and the other end 234 secured in a spring securing hole 243 formed at a flange portion 242 of the second hub 240.

A plurality of holding protrusions 252 are formed at an outer peripheral surface of the clutch hub 250 along a circumferential direction of the clutch hub 250. The holding protrusions 252 are adapted to interact with a locking member 263 of the restraint unit 260 and an end of a safety lever 400.

The restraint unit 260 includes a bracket 261, an actuator 262 supported by the bracket 261, and the locking member 263 installed to be moved by the actuator 262. The locking member 263 is movable between a locking position where the locking member 263 interferes with any one of the holding protrusions 252 of the clutch hub 250 and an unlocking position where the locking member 263 is spaced apart from the holding protrusions 252. The locking member 263 is hingedly coupled to the bracket 261 and has a holding extension 263*a* formed at one end of the locking member 263 to protrude toward the holding protrusions 252. An elastic member 264 is connected to the other end of the locking member 263 opposite to the one end with respect to a portion of the bracket 261. The elastic member 264 serves to elastically bias the other end of the locking member 263 such that the holding extension 263*a* of the locking member 263 is moved to the locking position.

Accordingly, if electric current is applied to the actuator 262, the locking member 263 is pulled toward the actuator 262 by a magnetic force such that the holding extension 263*a* of the locking member 263 is moved away and spaced apart from the holding protrusions 252 of the clutch hub 250. On the other hand, if no electric current is applied to the actuator 262, the holding extension 263*a* is moved toward the clutch hub 250 by an elastic force of the elastic member 264 so as to interfere with any one of the holding protrusions 252. As a result, movement of the clutch hub 250 is restrained by the restraint unit 260.

If the clutch gear 210 rotates in a direction as indicated by the arrow A of FIG. 4 upon receiving a rotating force from the drive source 12, the first hub 220 is rotated in the direction as indicated by the arrow A along with the clutch gear 210. In this case, if the locking member 263 is moved to the unlocking position by operation of the actuator 262, the clutch spring 230, which comes into frictional contact with the first hub 220, is distorted such that an inner radius of the clutch spring 230 decreases, thereby acting to tighten outer peripheral surfaces of the first and second hubs 220 and 240. Thereby, a rotating force of the first hub 220 is transmitted to the second hub 240 through the clutch spring 230, so as to allow the second hub 240 to rotate along with the first hub 220. However, in a state wherein the actuator 262 is turned off, movement of the clutch hub 250 is restrained by the restrain unit 260. Accordingly, the clutch spring 230 has no function of tightening the outer peripheral surfaces of the first and second hubs 220 and 240 even if the first hub 220 is rotated in the direction as indicated by the arrow A and thus, only the first hub 220 performs idling rotation and no power is transmitted to the second hub 240.

If power is transmitted to the second hub 240, the power is subsequently transmitted to the coupling gear 134 of the paper feeding cassette 101 by the power transmission device 300. In the present embodiment, the power transmission device 300 includes at least one worm gear. Using the worm gear is advantageous to obtain a high reduction ratio. Accordingly, the power transmission device 300 of the present invention can achieve an appropriate pivotal rotating speed of the lifting member 132 with a very simplified configuration.

As shown in FIGS. 2 and 3, the power transmission device 300 includes a first rotating shaft 320 coupled to the second hub 240 so as to rotate together with the second hub 240, a second rotating shaft 330 extending perpendicular to the first rotating shaft 320, and a third rotating shaft 340 extending perpendicular to the second rotating shaft 330 to be directed toward the coupling gear 134 of the paper feeding cassette 101.

In the present embodiment, the at least one worm gear includes a first worm gear 310*a* to transmit power between the first rotating shaft 320 and the second rotating shaft 330, and a second worm gear 310*b* to transmit power between the second rotating shaft 330 and the third rotating shaft 340. The first worm gear 310*a* includes a first worm 311 formed at the first rotating shaft 320 and a first worm wheel 312 formed at one end of the second rotating shaft 330 to be engaged with the first worm 311. The second worm gear 310*b* includes a second worm 313 formed at the other end of the second rotating shaft 330 and a second worm wheel 314 formed at the third rotating shaft 340 to be engaged with the second worm 313.

The third rotating shaft 340 has the coupling portion 341 to be coupled with the coupling gear 134 when the paper feeding cassette 101 is mounted to the body 10. The coupling portion 341 is formed at an end of the third rotating shaft 340 to face the coupling gear 134 and has a coupling groove (not shown) that will be engaged with a coupling rib 134*a* formed in the coupling gear 134.

Meanwhile, as shown in FIG. 3, the image forming apparatus according to an exemplary embodiment of the present general inventive concept further includes the safety lever 400 that operates in cooperation with the up-down movements of the pickup roller assembly 102. The safety lever 400 has one end 401 coupled to the pickup bracket 142 so as to cooperate with the pickup roller assembly 102 and the other end 402 extending toward the clutch hub 250 of the power intermittence device 200. The safety lever 400 is centrally provided with a pivoting shaft 403 such that the safety lever 400 is supported in a pivotally rotatable manner by the pivoting shaft 403. Accordingly, if the pickup roller assembly 102 is lifted, the safety lever 400 is pivotally rotated in cooperation with the pickup roller assembly 102 with respect to the pivot shaft 403 such that the other end 402 of the safety lever 400 is lowered. Conversely, if the pickup roller assembly 102 is lowered, the other end 402 of the safety lever 400 is lifted.

With the pivotal rotation of the safety lever 400, the other end 402 of the safety lever 400 is moved between a locking position where the other end 402 interferes with any one of the holding protrusion 252 to restrain movement of the clutch hub 250 and an unlocking position where the other end 402 is spaced apart from the holding protrusions 252 to allow rotation of the clutch hub 250.

Compared to a conventional image forming apparatus causing damage on a power transmission train to hold the power transmitted to the a pickup and feeding device or to maintain a transmission state of the power, the image forming apparatus according to the embodiment of the present general inventive concept prevents the damage by selectively disconnecting or separating the power to be transmitted from the driving source 12 to a lifting mechanism lifting the paper loading tray 120, for example, through the power transmission device 300. Accordingly, the power intermittence device 200 can disconnect or separate the driving source 12 to the lifting mechanism so as not to transmit the power from the driving source 12 to the lifting mechanism according to a state of the paper feeding cassette 101, for example, a height of the paper loaded in the paper loading tray 120. The height of the paper may be a height from a bottom the paper feeding cassette 101, a height from a surface of the paper loading tray 120, or a distance between a paper pickup and feeding path and one of the paper and the paper loading tray 120.

Figure 5:
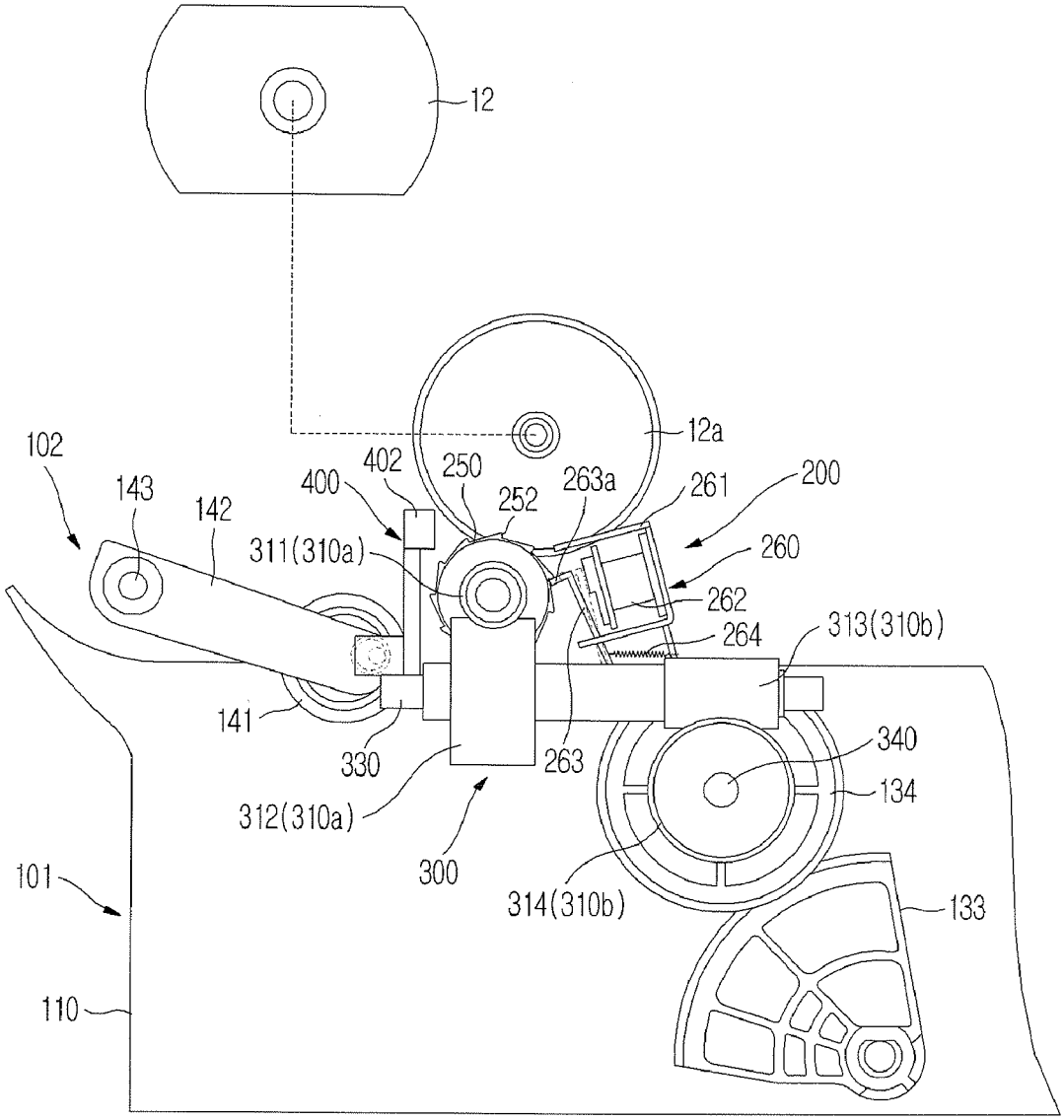
FIGS. 5 and 6 are schematic views showing an operation of an image forming apparatus according to an exemplary embodiment of the present general inventive concept.
Figure 6:
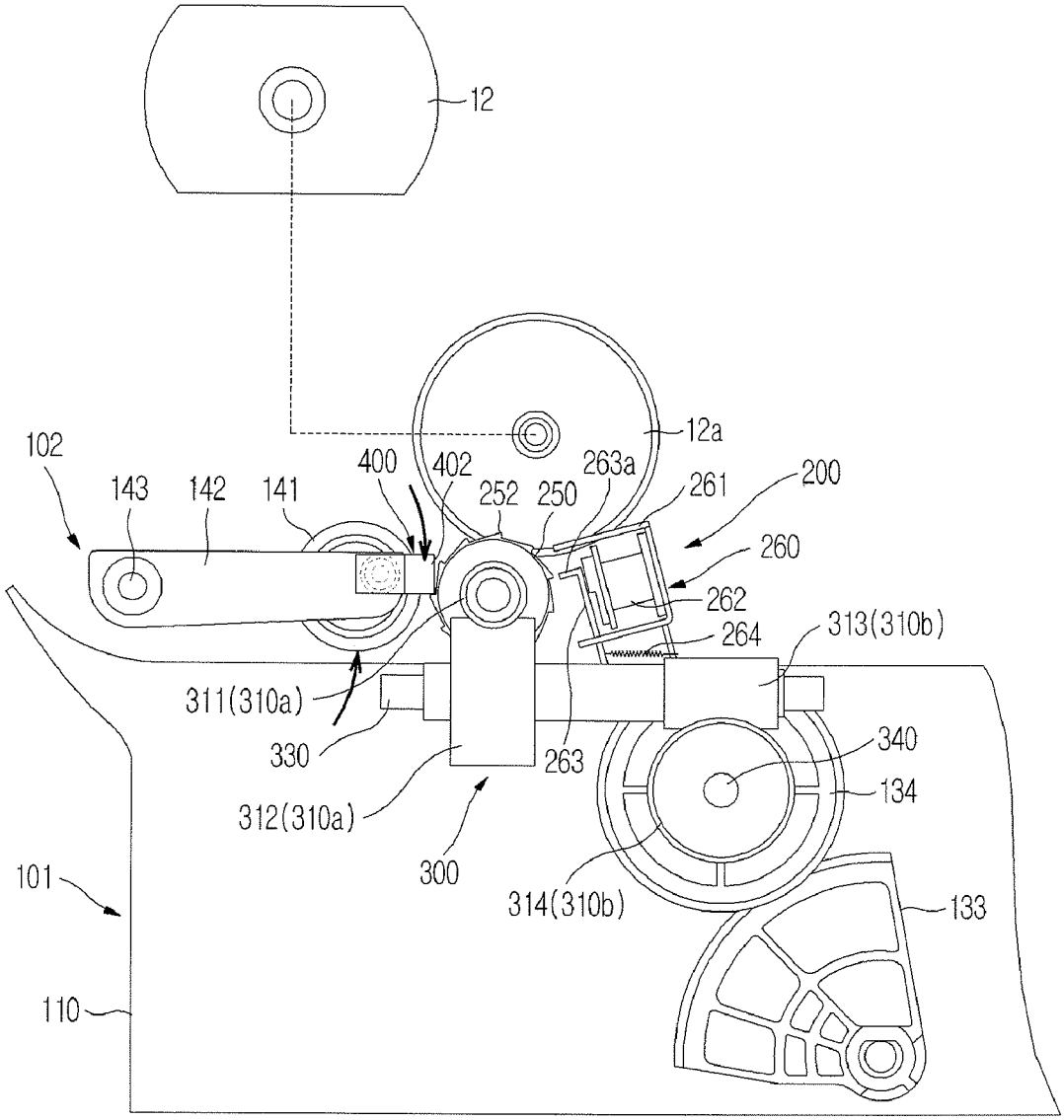

Hereinafter, the operation of the image forming apparatus according to an exemplary embodiment of the present general inventive concept will be described with reference to FIGS. 1 to 6. FIG. 5 is a view showing the installation of the paper feeding cassette 101 and the transmission of power from the drive source 12 to the lifting member 132, and FIG. 6 is a view showing the operation of the safety lever 400.

If the paper feeding cassette 101 is not mounted to the body 10, the pickup roller assembly 102 is in an upwardly moved state as shown in FIG. 2, and the other end 402 of the safety lever 40, which cooperates with the pickup roller assembly 102, interferes with any one of the holding protrusion 252 of the clutch hub 250, so as to prevent rotation of the clutch hub 250. Also, no electric current is applied to the actuator 262 of the restraint unit 260 and therefore, the locking member 263 also interferes with any one of the holding protrusions 252, so as to prevent rotation of the clutch hub 250. In this case, even if power is transmitted from the drive source 12 and the clutch gear 210 and the first hub 220 are rotated in the direction as indicated by the arrow A of FIG. 4, further transmission of the power is intercepted and no rotating force is transmitted to the second hub 240. Accordingly, the first and second worm gears 310*a* and 310*b* are not rotated (See FIG. 4).

Then, if the paper feeding cassette 101 is mounted to the body 10, the pickup roller assembly 102 is pivotally rotated about the supporting shaft 143 as shown in FIG. 5 under operation of the up-down member (not shown) such that the pickup roller 141 is lowered. Thereby, the other end 402 of the safety lever 400, which cooperates with the pickup roller assembly 102, is lifted so as to be spaced apart from the holding protrusions 252. However, the locking member 263 of the restraint unit 260 still restrains the clutch hub 250 because no electric current is applied to the actuator 262. Accordingly, the power of the drive source 12 is not transmitted to the lifting member 132 of the paper feeding cassette 101. Meanwhile, when the paper feeding cassette 101 is mounted to the body 10, the coupling gear 134 of the paper feeding cassette 101 is coupled to the coupling portion 341 provided at the end of the third rotating shaft 340 (See FIG. 3).

A lowered position of the pickup roller 141 is determined based on a height of the sheets of paper loaded in the paper loading tray 120. If the paper detecting sensor (13, See FIG. 1) determines that the height of the sheets of paper loaded on the paper loading tray 120 is lower than a predetermined reference height, the actuator 262 is operated. As indicated by a dotted line in FIG. 5, if the actuator 262 is operated, the locking member 263 is spaced apart from the holding protrusions 252 by a magnetic force, thus keeping the clutch hub 250 in a rotatable state. In this case, a rotating force of the first hub 220 is transmitted to the second hub 240 through the clutch spring 230 received in the clutch hub 250. Thereby, the first rotating shaft 320 is rotated along with the second hub 240 (See FIG. 4), and the power is transmitted through the first and second worm gears 310*a* and 310*b*, so as to rotate the third shaft 340. Accordingly, the coupling gear 134 of the paper feeding cassette 101 coupled with the coupling portion 341 of the third rotating shaft 340 is rotated along with the third rotating shaft 340, and the lifting gear 133 engaged with the coupling gear 134 is rotated. As a result, the lifting member 132 is rotated to lift the paper loading tray 120, thus allowing the height of sheets of paper loaded in the paper loading tray 120 to be raised.

If the paper detecting sensor 13 determines that the height of the sheets of paper loaded on the paper loading tray 120 reaches the predetermined reference height, the supply of electric current to the actuator 262 is intercepted, and the holding extension 263*a* of the locking member 263 is moved toward the clutch hub 250 by an elastic force of the elastic member 264, so as to restrain movement of the clutch hub 250. Thereby, no power is transmitted to the lifting member 132 and there is no further lifting of the paper loading tray 120.

Then, if a printing command is input, as shown in FIG. 1, the sheets of paper P loaded in the paper loading tray 120 are picked up one by one by the pickup roller 141 and moved along a predetermined path. Meanwhile, an electrostatic latent image is formed on the surface of the photosensitive drum 22 by the laser scanning unit 21. In this case, the photosensitive drum 22 was electrically charged by the electrical charging roller 23. The electrostatic latent image on the photosensitive drum 22 is developed into a toner image by the developing roller 24, and then, the toner image is transferred onto a sheet of paper by the transfer roller 25. The sheet of paper having the transferred toner image is introduced into a gap between the heating roller 32 and the pressing roller 33 such that the toner image is fixed on the sheet of paper with heat transferred from the interior of the heating roller 32 and a pressure between the heating roller 32 and the pressing roller 33. The sheet of paper, having passed through the above described printing process, is discharged out of the body 10 by the series of paper discharge rollers 41.

The above described printing process can be smoothly accomplished while the paper detecting sensor 13 and the actuator 262 perform normal operations. However, if the paper detecting sensor 13 fails to detect the height of sheets of paper, or the actuator 262 has a malfunction, there is a risk in that the paper loading tray 120 continues a lifting operation in spite of the fact that the paper loading tray 120 reaches the predetermined reference position. If the paper loading tray 120 continues lifting operation, the pickup roller 141, which is in contact with the sheets of paper, is lifted together, as shown in FIG. 6. Thereby, the safety lever 400 is pivotally rotated in cooperation with the pickup roller assembly 102 such that the other end 402 of the safety lever 400 restrains the clutch hub 250. Similarly, when the actuator 262 has a malfunction and thus, the locking member 263 fails to restrain the clutch hub 250 in time, it is possible to prevent power from being transmitted to the lifting member 132. Consequently, it is possible to prevent damage to constituent elements of the image forming apparatus due to the malfunction of the paper detecting sensor 13 or the actuator 262.

As apparent from the above description, the image forming apparatus according to the present general inventive concept is designed such that the paper loading tray can be lifted or lowered by use of a drive source, which is used to operate the paper feeding mechanism, developing mechanism, and so on, as well as the relatively cheap actuator without requiring a separate drive source for exclusive use with the paper loading tray. Accordingly, the present general inventive concept can accomplish a great reduction in element costs of the image forming apparatus.

The present general inventive concept is not limited to an electrophotographic image forming apparatus as described in FIG. 1. It is possible that an inkjet ejection type image forming apparatus and a film type image forming apparatus may be used as an image forming apparatus according to the present general inventive concept.

Further, even when electric devices included in the image forming apparatus, such as a sensor and an actuator, have a malfunction, the present general inventive concept has the effect of preventing damage to related constituent elements of the image forming apparatus by virtue of a mechanical safety device.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. An image forming apparatus comprising:

a body including an image forming unit and a drive source;

a paper feeding unit comprising:

a paper feeding cassette detachably coupled to the body, and including a paper loading tray and a pivotally rotatable lifting member to lift or lower the paper loading tray; and a pickup roller assembly installed above the paper loading tray in an upwardly and downwardly movable manner to pick up a sheet of paper stored in the paper feeding cassette, wherein the drive source provides power to be transmitted to the lifting member and the pickup roller assembly;

a power intermittence device to intermit the power to be transmitted from the drive source to the lifting member;

a safety lever having a first end connected to the pickup roller assembly and to move according to a movement of the pickup roller assembly to control the power intermittence device; and a power transmission device to transmit the power transmitted through the power intermittence device to the lifting member, wherein the power transmission device comprises at least one worm gear.

2. The image forming apparatus of claim 1, wherein the power intermittence device comprises:

a first hub rotatably connected to the drive source;

a clutch spring having a portion coupled to the first hub, a first end, and a second end;

a second hub coupled to the first end of the clutch spring;

a clutch hub disposed between the first hub and the second hub to surround the clutch spring to secure the second end of the clutch spring; and a restraint unit to restrain movement of the clutch hub.

3. The image forming apparatus of claim 2, wherein:

the power transmission device further comprises:

a first rotating shaft coupled to the second hub so as to rotate along with the second hub; and a second rotating shaft to extend in a direction perpendicular to the first rotating shaft, and the at least one worm gear comprises:

a first worm gear including a first worm formed at the first rotating shaft and a first worm wheel formed at a first end of the second rotating shaft to be engaged with the first worm; and a second worm gear including a second worm formed at a second end of the second rotating shaft and a second worm wheel to be engaged with the second worm.

4. The image forming apparatus of claim 2, wherein:

the clutch hub comprises:

at least two holding protrusions formed at an outer peripheral surface of the clutch hub; and the restraint unit comprises:

a locking member movable between a locking position where the locking member interferes with any one of the holding protrusions and an unlocking position where the locking member is spaced apart from the holding protrusions; and an actuator to move the locking member.

5. The image forming apparatus of claim 4, wherein the safety lever has a second end that is movable between a locking position where the second end of the safety lever interferes with any one of the holding protrusions and an unlocking position where the second end of the safety lever is spaced apart from the holding protrusions.

6. An image forming apparatus comprising:

a body including an image forming unit and a drive source;

a paper feeding cassette detachably coupled to the body, and including a paper loading tray and a pivotally rotatable lifting member to lift or lower the paper loading tray;

a pickup roller assembly installed to the body so as to move up and down above the paper loading tray;

a power intermittence device to intermit power to be transmitted from the drive source to the lifting member; and a safety lever having a first end connected to the pickup roller assembly, wherein the safety lever further has a second end that is pivotally rotatable between a first position where the second end of the safety lever contacts the power intermittence device to restrain the power intermittence device so as not to transmit the power to the lifting member and a second position where the second end of the safety lever is spaced apart from the power intermittence device so as to transmit the power to the lifting member.

7. The image forming apparatus of claim 6, further comprising:

a power transmission device to transmit the power transmitted through the power intermittence device to the lifting member, and wherein the power transmission device comprises at least one worm gear.

8. The image forming apparatus of claim 7, wherein the power intermittence device comprises:

a first hub rotatably connected to the drive source;

a second hub to be intermittently connected to the first hub by a clutch spring; and a clutch hub disposed between the first hub and the second hub to surround the clutch spring, a first end of the clutch spring being secured to the clutch hub.

9. The image forming apparatus of claim 8, wherein:

the power transmission device further comprises:

a first rotating shaft coupled to the second hub so as to rotate along with the second hub; and a second rotating shaft extending perpendicular to the first rotating shaft, and the at least one worm gear comprises:

a first worm gear including a first worm formed at the first rotating shaft and a first worm wheel formed at a first end of the second rotating shaft to be engaged with the first worm; and a second worm gear including a second worm formed at a second end of the second rotating shaft and a second worm wheel to be engaged with the second worm.

10. The image forming apparatus of claim 8, wherein:

the clutch hub comprises at least two holding protrusions formed at an outer peripheral surface of the clutch hub; and the second end of the safety lever is movable between a locking position where the second end of the safety lever interferes with any one of the holding protrusions and an unlocking position where the second end of the safety lever is spaced apart from the holding protrusions.

11. The image forming apparatus of claim 10, wherein the power intermittence device further comprises a restraint unit to interfere with any one of the holding protrusions so as to restrain movement of the clutch hub.

12. The image forming apparatus of claim 11, wherein the restraint unit comprises:

a locking member movable between a locking position where the locking member interferes with any one of the holding protrusions and an unlocking position where the locking member is spaced apart from the holding protrusions; and an actuator to move the locking member.

13. An image forming apparatus comprising:

a paper feeding cassette having a paper loading tray and a pivotally rotatable lifting member to lift or lower the paper loading tray;

a body to receive the paper feeding cassette, wherein the body includes an image forming unit and a drive source;

a power intermittence device to selectively disconnect power to be transmitted from the drive source to the lifting member;

a pickup roller assembly to move between a first position and a second position according to a connection between the paper feeding cassette and the body; and a safety lever having a first end connected to the pickup roller assembly and to move according to a movement of the pickup roller assembly to control the power intermittence device.

14. The image forming apparatus of claim 13, wherein the power intermittence device intermittently transfers the power to the lifting member and separate the drive source and the lifting member according to a height of one or more sheets of paper.

15. The image forming apparatus of claim 13, further comprising:

a sensor to detect a height of one or more sheets of paper contained in the paper feeding cassette, wherein the power intermittence device intermittently transfers the power from the drive source according to the detected height of the one or more sheets of paper.

16. The image forming apparatus of claim 13, further comprising:

an actuator to control the power intermittence device.

17. The image forming apparatus of claim 13, further comprising:

a power transmitting device having at least one worm gear disposed between the power intermittence device and the lifting member.

18. The image forming apparatus of claim 13, further comprising:

a coupler gear to couple the lifting member to the power intermittence device when the paper feeding cassette is coupled to the body.

19. The image forming apparatus of claim 13, further comprising:

a paper feeding unit to feed a sheet of paper contained in the paper feeding cassette, wherein the drive source outputs the power to the paper feeding unit to feed the paper to the image forming unit from the paper feeding cassette.

20. An image forming apparatus comprising:

a body including an image forming unit and a drive source;

a paper feeding unit comprising:

a paper feeding cassette detachably coupled to the body, and including a paper loading tray and a pivotally rotatable lifting member to lift or lower the paper loading tray; and a pickup roller assembly to pick up a sheet of paper stored in the paper feeding cassette and to move between a first position and a second position according to a connection between the paper feeding cassette and the body, wherein the drive source provides power to be transmitted to the lifting member and the pickup roller assembly;

a power intermittence device to selectively disconnect power to be transmitted from the drive source to the lifting member; and a safety lever having a first end connected to the pickup roller assembly and to move according to a movement of the pickup roller assembly to control the power intermittence device.

21. The image forming apparatus of claim 20, wherein the first end of the safety lever cooperates with the pickup roller assembly, and the safety lever further comprises:

a second end that is pivotally rotatable between a first position where the second end of the safety lever restrains the power intermittence device so as not to transmit the power to the lifting member and a second position where the second end of the safety lever is spaced apart from the power intermittence device so as to transmit the power to the lifting member.

22. The image forming apparatus of claim 20, further comprising:

a power transmitting device having at least one worm gear disposed between the power intermittence device and the lifting member.

* * * * *